US006726251B2

(12) United States Patent
Spaeth et al.

(10) Patent No.: US 6,726,251 B2
(45) **Date of Patent: *Apr. 27, 2004**

(54) BOOKLET

(75) Inventors: Marty Spaeth, Port Washington, WI (US); Dave Petrovic, Port Washington, WI (US)

(73) Assignee: JLG Omniquip, Inc., Hagerstown, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/082,359

(22) Filed: Feb. 26, 2002

(65) Prior Publication Data

US 2002/0121774 A1 Sep. 5, 2002

Related U.S. Application Data

(63) Continuation of application No. 09/114,079, filed on Jul. 13, 1998, now Pat. No. 6,349,969.

(51) Int. Cl.[7] ..... B42D 1/00

(52) U.S. Cl. ..... 281/15.1; 281/21.1; 281/40; 283/63.1; 402/73

(58) Field of Search ..... 402/70–78, 46, 402/48, 51, 53; 281/15.1, 21.1, 22, 44, 45, 49, 40, 31; 283/63.1, 64

(56) References Cited

U.S. PATENT DOCUMENTS 792,747 A * 6/1905 Anderson et al. ..... 402/70
943,479 A * 12/1909 Smithson ..... 281/5
959,470 A * 5/1910 Creasey ..... 281/47
1,000,649 A * 8/1911 Walker, Jr. ..... 402/26
1,079,418 A 11/1913 Krumming
2,111,845 A * 3/1938 Dunham ..... 402/4
2,207,604 A * 7/1940 Whiton ..... 281/40
4,201,403 A * 5/1980 Turner ..... 283/74
5,104,147 A 4/1992 King
5,941,569 A 8/1999 Solomons
6,349,969 B1 * 2/2002 Spaeth et al. ..... 281/15.1

* cited by examiner

*Primary Examiner*—Monica S. Carter
(74) *Attorney, Agent, or Firm*—Dickstein Shapiro Morin & Oshinsky LLP

(57) ABSTRACT

A booklet having a base, a plurality of pages having at least one mounting portion and a plurality of display portions. The mounting portions are hinged with respect to the display portions. The mounting portions have page engaging members, and the base has base engaging members. The base engaging members are configured to engage the page engaging members to attach the mounting portions to the base and to provide for the mounting portions to move with respect to the base to allow the display portions to move to a greater extent than the display portions would move without such movement of the mounting portions, to allow the display portions to lie more flat against one another when the pages are turned. The base engaging members may include pins mounted on the base, and the page engaging members include holes formed through the mounting portions, the pins extending through the holes. The holes may be elongated. Alternatively, the base engaging members and the page engaging members may include at least one protrusion and at least one recess, the protrusion engaging the recess. The mounting portions are hinged with respect to the plurality of display portions by at least one hinge member. The hinge member may include at least one hinge sheet and/or at least one hinge wire.

23 Claims, 6 Drawing Sheets

BOOKLET

CROSS REFERENCE TO RELATED APPLICATIONS

The present application is a continuation application of U.S. application Ser. No. 09/114,079, filed Jul. 13, 1998, now U.S. Pat. No. 6,349,969 issued on Feb. 26, 2002, the disclosure of which is herewith incorporated by reference in its entirety.

BACKGROUND

The present invention relates to booklets and more specifically, to loose-leaf booklets.

Booklets of information may be used in extreme environments, such as by workmen. For example, workman operating mobile material handlers, such as extending boom aerial platforms, use booklets showing load charts. These load charts are used to inform the operator of limits on the weight the machine may lift at various angles and various boom extension lengths. The operator may be working under severe temperature conditions and may be wearing gloves. Moreover, the operator may need to pay attention to operating the machine at the same time he is locating information in the booklet.

Known booklets include bound booklets and spiral loose-leaf booklets. Bound booklets fix the inner edges of the pages together. Thus, the pages must be flexible to lie flat against one another. Flexible pages do not hold up well under abuse and are difficult to handle with gloves and under extreme circumstances. Spital loose-leaf booklets work better with stiff pages, but the pages tend to get caught on the spirals and may break, particularly in extreme cold.

Accordingly, there is a need for a booklet that is easy to use by the operator under severe conditions. The booklet should withstand the extreme environment of the outdoors and a great amount of abuse. The pages should lie flat and be easily flipped even with a gloved hand. The information in the booklet should be readable by the operator even if the book becomes scratched. For vehicle applications, the booklet should be securely fastened to the dash.

SUMMARY

The disadvantages of the prior art are overcome to a great extent by the present invention, which provides a booklet having a base, a plurality of pages having at least one mounting portion and a plurality of display portions. The mounting portions are hinged with respect to the display portions. The mounting portions have page engaging members, and the base has base engaging members. The base engaging members are configured to engage the page engaging members to attach the mounting portions to the base and to provide for the mounting portions to move with respect to the base to allow the display portions to move to a greater extent than the display portions would move without such movement of the mounting portions, to allow the display portions to lie more flat against one another when the pages are turned.

In one aspect, the base engaging members include pins mounted on the base, and the page engaging members include holes formed through the mounting portions, the pins extending through the holes. The holes may be elongated.

In another aspect, the base engaging members and the page engaging members include at least one protrusion and at least one recess, the protrusion engaging the recess. The protrusions and recesses may be on either the mounting portions or the base, or on both.

In another aspect, the mounting portions are hinged with respect to the plurality of display portions by at least one hinge member. The hinge member may include at least one hinge sheet and/or at least one hinge wire.

In yet another aspect, the display portion includes a display portion hinge edge and the mounting portion includes a mounting portion hinge edge, at least one hinge sheet extending between the mounting portion hinge edge and the display portion hinge edge to form a hinge therebetween. The respective hinge edges of said hinged-together mounting portion and display portion may be of substantially the same length. The hinge sheet may be substantially the same length as the hinge edges of the hinged-together mounting portion and display portion to hinge together those portions along substantially their entire hinge edge lengths.

In another aspect, the hinge sheet includes a mounting portion engaging portion, the engaging portion being engaged with the hinged-together mounting portion. The mounting portion is a sheet having a mounting sheet surface, the hinge sheet engaging portion is an area of a sheet surface of said hinge sheet, and that area is adhered to said mounting sheet surface. The adhered area extends over less than the entire mounting sheet surface.

In still another aspect, a second display portion includes a second display portion hinge edge, at least one hinge sheet extends between the hinged-together display portion and the second display portion hinge edge to form a hinge therebetween.

In another aspect, a second mounting portion includes a second mounting portion hinge edge, at least one hinge sheet extends between the hinged-together second display portion and the second mounting portion hinge edge to form a hinge therebetween.

It is an object of the present invention to provide a booklet.

It is a further object of the invention to provide a loose-leaf booklet.

It is another object of the invention to provide a booklet that is easy to use under severe conditions.

It is yet another an object of the invention to provide a booklet having the foregoing advantages and that may withstand the extreme environment of the outdoors and a great amount of abuse.

It is still another object of the invention to provide a booklet having the foregoing advantages and having pages that will lie flat and be easily flipped even with a gloved hand.

It is a further object of the invention to provide a booklet having the foregoing advantages and wherein the information in the booklet is readable by the operator even if the book becomes scratched.

It is yet a further object of the invention to provide a booklet having the foregoing advantages and wherein, for vehicle applications, the booklet is securely fastened to the dash.

Other objects, features and advantages of the present invention will become apparent from the following detailed description and drawings of preferred embodiments of the present invention.

DESCRIPTION OF PREFERRED EMBODIMENTS

Figure 1:
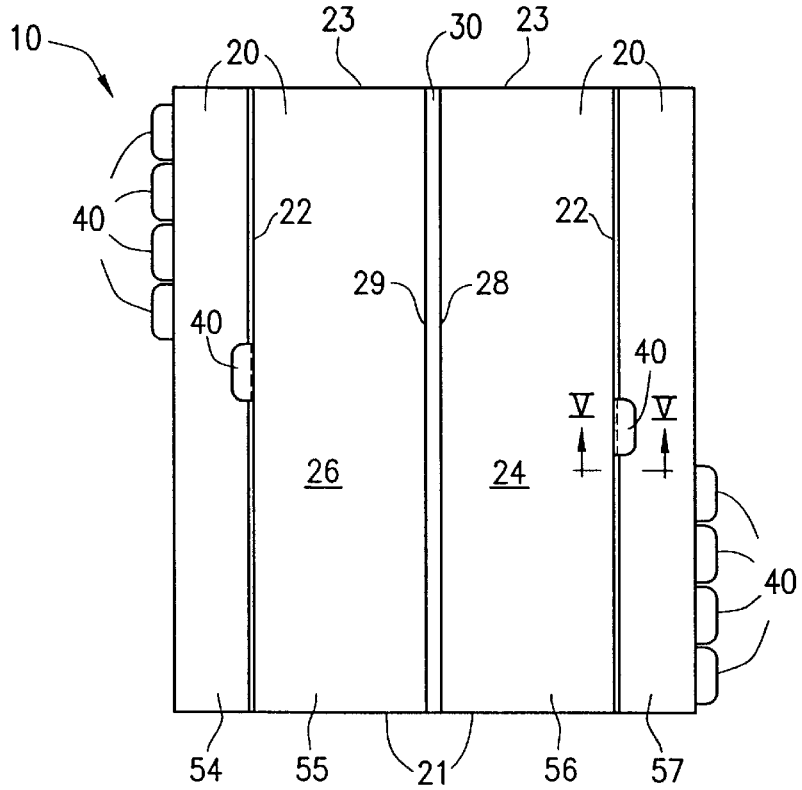
FIG. 1 is a front view of a first embodiment of a booklet constructed in accordance with the present invention.

Refer now to FIGS. 1 through 8 of the drawings, there being shown a booklet, generally designated by reference numeral 10, according to a preferred embodiment of the present invention. Booklet 10 includes a base 12 (FIG. 7) and pages, generally designated by reference numeral 14. The pages 14 have mounting portions, generally designated by reference numeral 80, and display portions, generally designated by reference numeral 20. In the embodiment shown, the pages 14 include pages 51, 52, 53, 54, 55, 56, 57, 58, 59, and 60, having separate corresponding display portions 20 and sharing mounting portions 82 and 84. The mounting portions 80 are hinged with respect to the display portions 20.

Figure 2:
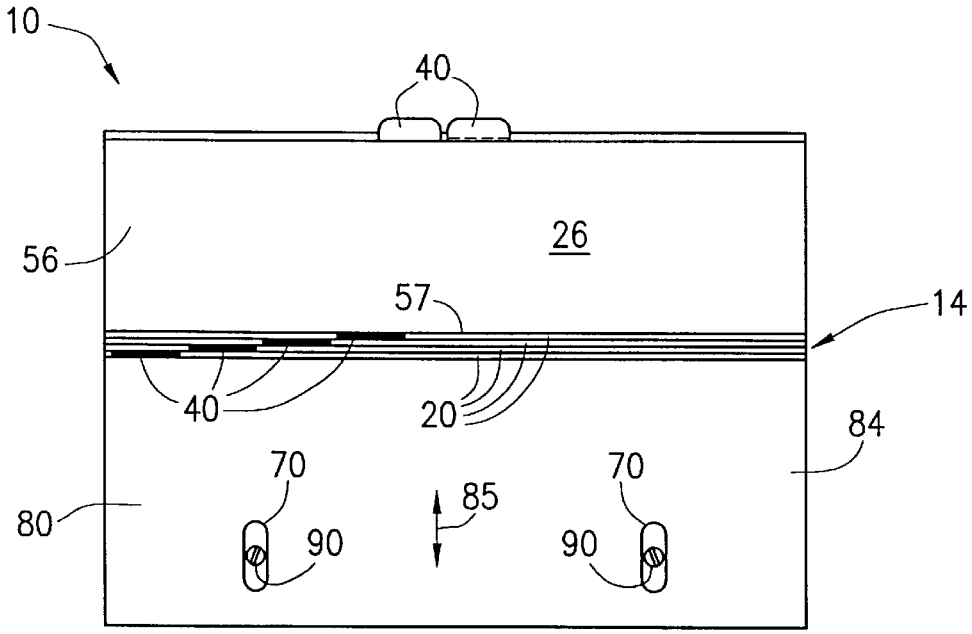
FIG. 2 is a right side view of the booklet of FIG. 1.
Figure 3:
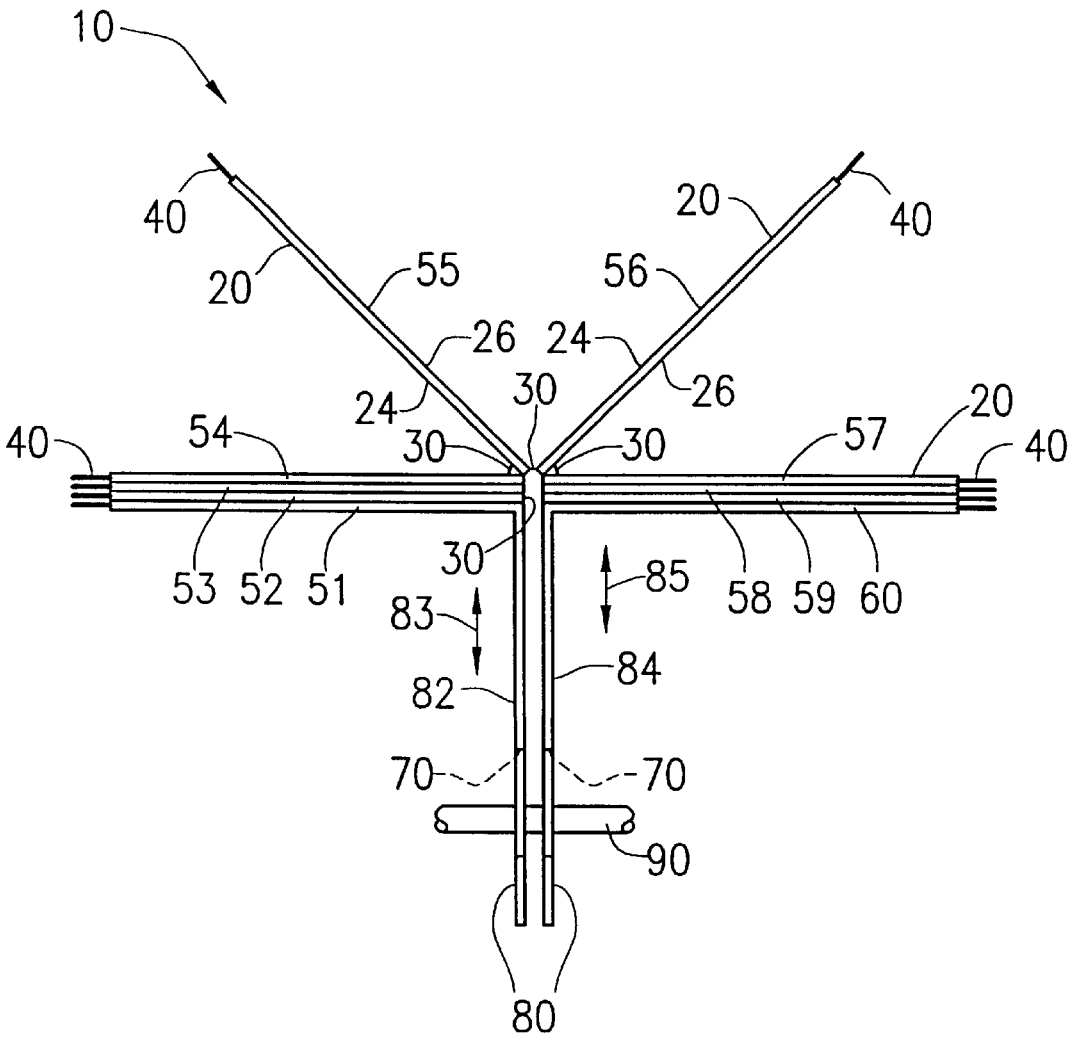
FIG. 3 is a front side view of the booklet of FIG. 1.

The mounting portions 80 and the base 12 are configured to hold the mounting portions 80 to the base 20 while allowing the mounting portions 80 to slide up and down with respect to the base 20 in the direction of the arrows 83 and 85. As shown in FIGS. 2 and 3, this mounting is effected by way of base engaging members, in the form of a pair of mounting pins 90 attached to the base 20 and extending through page engaging members, in the form of two corresponding mounting holes 70 formed in the mounting portions 82 and 84. The holes 70 should be sized to allow the mounting portions 80 to move up and down so the display portions 20 of the pages 14 may move to a greater extent than the display portions 20 would move without such movement of the mounting portions 80, to allow the display portions 20 to lie more flat against one another when the pages 14 are turned, as shown in FIG. 3.

Each display portion 20 of the illustrated embodiment includes a front face 24 and a back face 26. The faces 24 and 26 have top edges 23 and bottom edges 21 connected at the outside by outer edge 22. The top and bottom edges are connected at the insides by an inner edge 28 for the front face 24 and by an inner edge 29 for the back face 26. In the embodiment shown, the edges 28 and 29 are hinge edges adjacent hinge sheet 30 as described below with respect to FIG. 4. The tabs 40 are positioned along the outer edges 22 to allow the user to select a desired page 14. Preferably, the tabs 40 are sized and shaped and located at staggered positions so that they may be easily and individually selected by a gloved hand. The tabs 40 may be affixed to the display portions 20 as shown in FIG. 5. The tabs 40 are shown at edges 22, but could also be positioned at edges 21 and/or 23. Page numbers or other identifiers may be marked on the tab 40, which may be manipulated by the user to turn the page.

Figure 6:
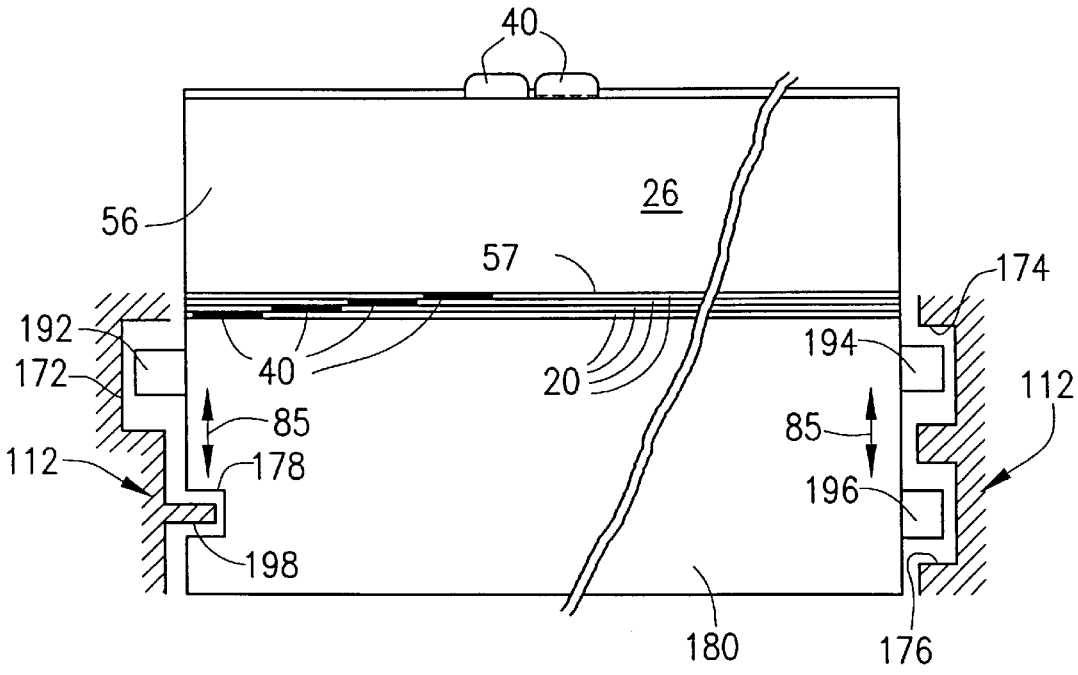
FIG. 6 is a view like FIG. 2, showing alternate embodiment mounting engagements.

In alternate preferred embodiments shown in FIG. 6, the mounting of mounting portions 180 is effected by way of protrusions engaging recesses. The protrusions and recesses may be positioned on the mounting portions and/or the base. As shown at the left of FIG. 6., a protrusion in the form of a tab 192, is part of and extending from the mounting portion 180 to engage the recess 192 of the base 112. Also on the left side, a protrusion 198 is part of and extending from the base 112 to engage the recess 178 of the mounting portion 180. As shown at the right of FIG. 6., a two protrusions in the form of a tabs 194 and 196 are part of and extending from the mounting portion 180 to engage the recesses 174 and 176 of the base 112. The recess and protrusion engaging members are sized and positioned to allow for movement of the mounting portion 180 in the direction of arrows 85 as discussed above with respect to mounting portion 80.

Figure 4:
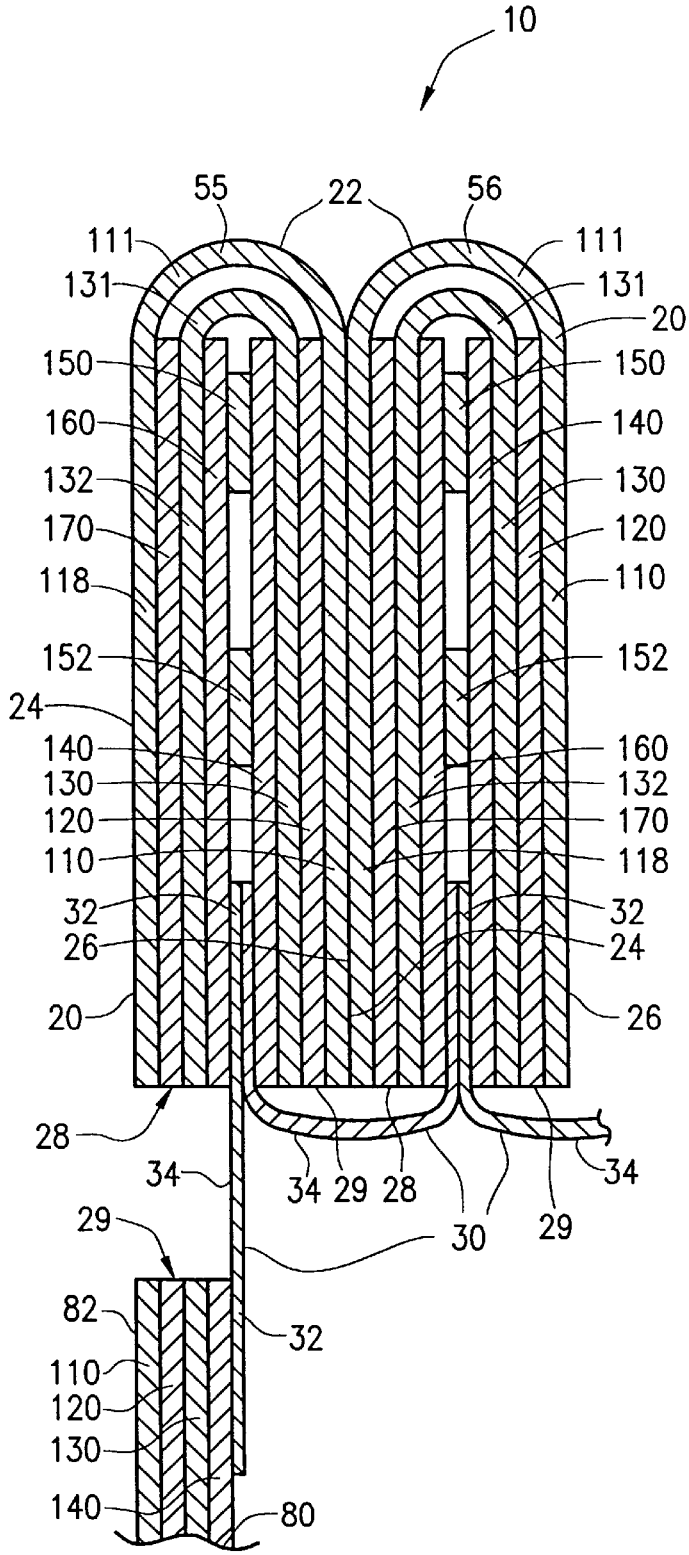
FIG. 4 is a section view of a portion of the hinge area of the booklet of FIG. 1.
Figure 5:
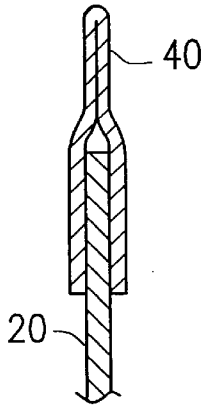
FIG. 5 is a cross-sectional view of a tab of the booklet taken along line V—V of FIG. 1.

Refer to FIG. 4 which shows a partial cross-section of the display portions 20 and mounting portion 82 of pages 55 and 56. The dimensions of the component parts have been exaggerated to show schematically the construction of an embodiment of the pages of the booklet 10. Each display portion 20 includes a front face 24 and a back face 26. In the FIG. 4, the back face 26 of page 55 is flat against the front face 24 of page 56. The front faces 24 include an outer front reinforcing sheet 118 affixed, such as by lamination, to a front printed sheet 170. The printed sheet 170 can be read through, and is protected by, the reinforcing sheet 118. The front printed sheet 170 is affixed, such as by gluing to a front adhesive sheet 132 which is affixed, such as by lamination to an inner front reinforcing sheet 160. The back faces 26 include an outer back reinforcing sheet 110 affixed, such as by lamination, to a back printed sheet 120. The printed sheet 120 can be read through, and is protected by, the reinforcing sheet 110. The back printed sheet 120 is affixed, such as by gluing to a back adhesive sheet 130 which is affixed, such as by lamination to an inner back reinforcing sheet 140. The inner front reinforcing sheet 118 and the inner back reinforcing sheet 140 are held together, such as by adhesive or double sided tape 150 and 152. The edges of the component may be interconnected at outer edges 22 of display portions 20. In the illustrated embodiment, the outer front and back reinforcing sheets 110 and 118 are formed as one piece and interconnected by member 111 along edge 22. Also in the illustrated embodiment, the front and back adhesive sheets 132 and 130 are formed as one piece and interconnected by member 131 along edge 22. The members 111 and 131 may extend along the entire length of edge 221. The mounting portion 82 may be similarly constructed as an inner and/or outer faces of the display portions 20.

Hinge sheets 34 extend between and overlap and engage the inner edges, hinge edges, 28 and 29 of respective adjacent display portions and adjacent display and mounting portions. The overlapping engaging portions 32 of hinge sheets 34 may extend over an area less than the area of the inner or outer surfaces of display portions 20 and mounting portions 80. The respective hinge edges of said hinged-together mounting portion and display portion may be of substantially the same length. The hinge sheet may be substantially the same length as the hinge edges of the hinged-together mounting portion and display portion to hinge together those portions along substantially their entire hinge edge lengths.

The construction illustrated allows separate assembly of the outer reinforcing sheets with the printed sheets on the one hand, and the inner reinforcing sheets and adhesive sheets of the other hand. The reinforcing sheets are relatively stiff to withstand abuse and weather resistant. Preferably the information on the printed sheets remain readable even if the reinforcing sheets become scratched.

The adhesive sheet should be compatible for adhering to the printed sheet. The hinge sheets should be relatively flexible for easy turning of the pages, yet tough to withstand abuse. The construction is shown by way of example, other constructions may be used. For example, the hinge could be formed by thinning the relatively stiff material forming all or a portion of the display portions and/or the mounting portions, such as by forming a so-called living hinge 30. Moreover, tough wire, such as piano wire could be used, rather than a sheet material, to make a hinge 30.

Figure 7:
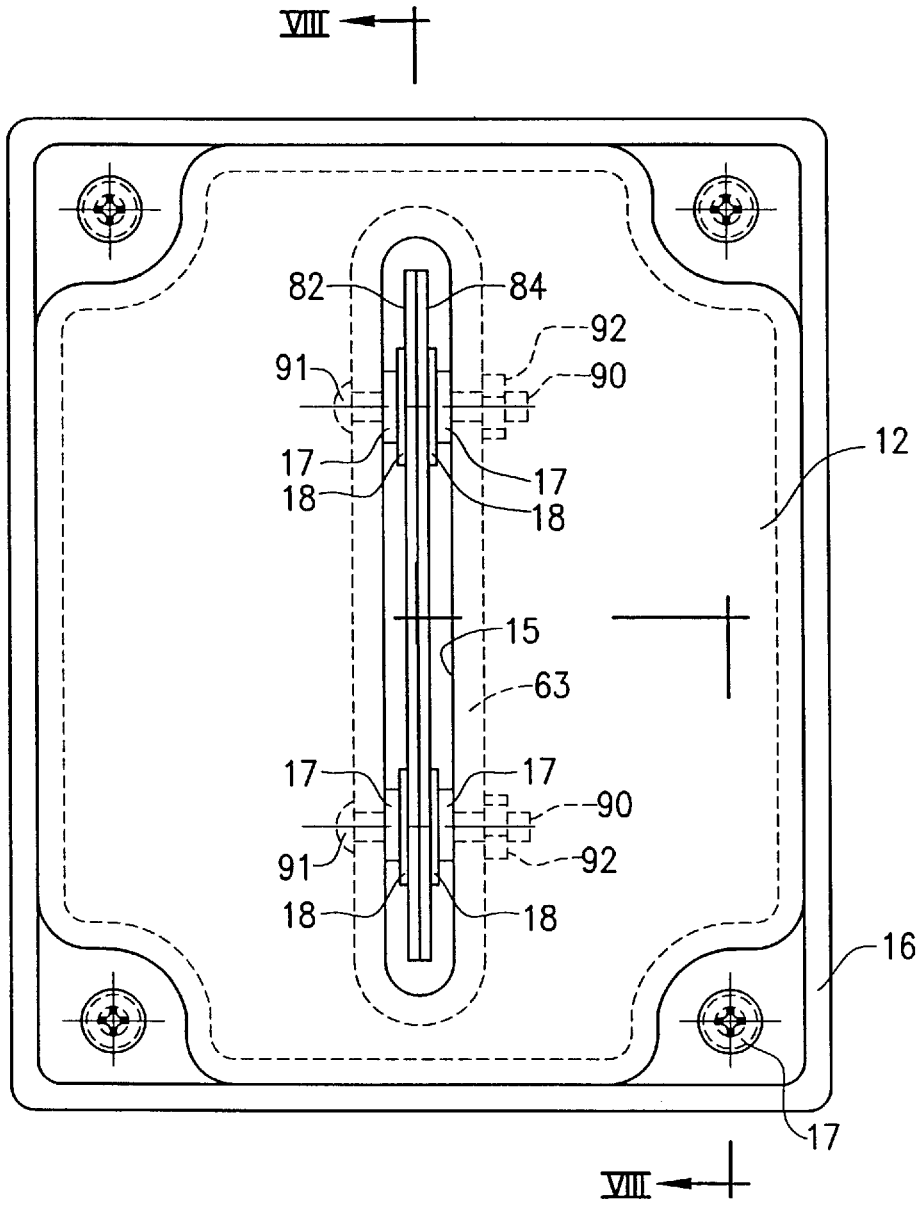
FIG. 7 is a front view of a base for the booklet of FIG. 1.
Figure 8:
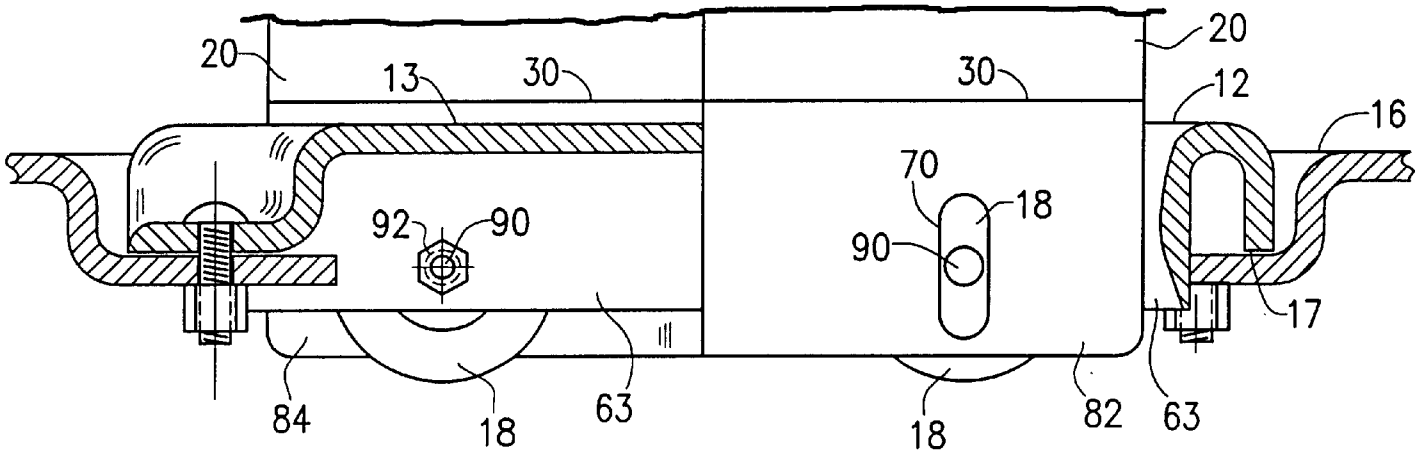
FIG. 8 is a cross-sectional view taken along line VIII—VIII of FIG. 7.

Refer to FIGS. 7 and 8 which show a base 12 for the booklet 10. The base 12 has a recess or opening 15 for receiving the mounting portions 80 of the pages 14. The mounting portions 80 have two slots 70 oriented generally transversely with respect to the hinge 30. Pins 90 include bolts 91 and nuts 92 and extend through each of the slots 70 to loosely engage the mounting portions 80 and extend through the holes 62 to engage a downwardly extending mounting flange 63 of the base 12. In the embodiment shown, the flange 63 defines the opening 15. Spacers 17 and washers 18 are be provided on the pin and may be added, removed or otherwise adjusted to obtain the desired degree of looseness for the number of mounting portions 80 engaged. The base 12 has a table surface to provide a resting position for the display portions 20. The base is mounted to a dash 16 of a vehicle, such as in the cab of a telescopic handler, by bolts 17.

The above description and drawings are only illustrative of preferred embodiments of the present invention, and are not intended to limit the present invention thereto. For example, the embodiment shown has a set of ten display portions hinged together and hinged to two mounting portions, however the invention is not limited to this arrangement. More than one set of pages could be used in one base, provided that sufficient movement of the mounting portions is allowed for the display portions of the pages to turn. Moreover, more or less than ten pages may be used with more or less than two mounting portions. Also, for example, the base of the booklet is shown configured for mating to a vehicle, but may be configured for mating to other structure or for portable use. Any subject matter or modification thereof which comes within the spirit and scope of the following claims is to be considered part of the present invention.

What is claimed as new and desired to be protected by Letters Patent of the United States is:

1. A booklet comprising:

a base;

a plurality of pages having at least one mounting portion and a plurality of display portions;

said at least one mounting portion being hinged with respect to said plurality of display portions;

said at least one mounting portion having at least one page engaging member, and said base having at least one base engaging member, said at least one base engaging member being configured to engage said at least one page engaging member to attach said at least one mounting portion to said base and to provide for said at least one mounting portion to move with respect to the base to allow said display portions to move to a greater extent than said display portions would move without such movement of said at least one mounting portions, to allow said display portions to lie more flat against one another when said pages are turned.

2. A booklet as in claim 1 wherein said at least one base engaging member includes at least one pin mounted on said base, and said at least one page engaging member includes at least one hole formed through said at least one mounting portion, said at least one pin extending through said at least one hole.

3. A booklet as in claim 1 wherein said at least one base engaging member and said at least one page engaging member includes at least one protrusion and at least one recess, said at least one protrusion engaging said at least one recess.

4. A booklet as in claim 2 wherein at least one of said at least one holes is elongated.

5. A booklet as in claim 2 wherein there are two of said pins and two of said holes, and each of said pins extends through a corresponding single one of said holes.

6. A booklet as in claim 3 wherein at least one of said at least one protrusion is on said at least one mounting portion and at least one of said at least one recess is on said base.

7. A booklet as in claim 3 wherein at least one of said at least one protrusion is on said base and at least one of said at least one recess is on said at least one mounting portion.

8. A booklet as in claim 6 wherein at least one of said at least one protrusion is on said base and at least one of said at least one recess is on said at least one mounting portion.

9. A booklet as in claim 1 further wherein said at least one mounting portion is hinged with respect to said plurality of display portions by at least one hinge member.

10. A booklet as in claim 9 wherein said at least on hinge member includes at least one hinge sheet.

11. A booklet as in claim 9 wherein said at least on hinge member includes at least one hinge wire.

12. A booklet as in claim 10 wherein at least one of said plurality of display portions includes a display portion hinge edge and at least one of said at least one mounting portion includes a mounting portion hinge edge, at least one of said at least one hinge sheet extending between a first said mounting portion hinge edge and a first said display portion hinge edge to form a hinge therebetween.

13. A booklet as in claim 12 wherein the respective hinge edges of said hinged-together mounting portion and display portion are of substantially a same length.

14. A booklet as in claim 13 wherein said hinge sheet is at least substantially a same length as said hinge edges of said hinged-together mounting portion and display portion to hinge together said portions along substantially their entire hinge edge lengths.

15. A booklet as in claim 12 wherein said hinge sheet includes a mounting portion engaging portion, said engaging portion being engaged with said hinged-together mounting portion.

16. A booklet as in claim 15 wherein said mounting portion is a sheet having a mounting sheet surface, said hinge sheet engaging portion is an area of a sheet surface of said hinge sheet, and said area being adhered to said mounting sheet surface.

17. A booklet as in claim 16 wherein said adhered area extends over less than the entire mounting sheet surface.

18. A booklet as in claim 12 wherein a second one of said plurality of display portions includes a second display portion hinge edge, at least one of said at least one hinge sheet extending between said hinged-together display portion and said second display portion hinge edge to form a hinge therebetween.

19. A booklet as in claim 18 wherein a second one of said at least one mounting portions includes a second mounting portion hinge edge, at least one of said at least one hinge sheet extending between said hinged-together second display portion and said second mounting portion hinge edge to form a hinge therebetween.

20. A booklet comprising:

a base;

a plurality of pages having at least one mounting portion and a plurality of display portions;

said at least one mounting portion being hinged with respect to said plurality of display portions;

said at least one mounting portion having at least one page engaging member, and said base having at least one base engaging member, said at least one base engaging member being configured to engage said at least one page engaging member to attach said at least one mounting portion to said base and to provide for said at least one mounting portion to move with respect to the base to allow said display portions to move to a greater extent than said display portions would move without such movement of said at least one mounting portions, to allow said display portions to lie more flat against one another when said pages are turned, wherein said at least one base engaging member and said at least one page engaging member includes at least one protrusion and at least one recess, said at least one protrusion engaging said at least one recess.

21. A booklet as in claim 20 wherein at least one of said at least one protrusion is on said at least one mounting portion and at least one of said at least one recess is on said base.

22. A booklet as in claim 20 wherein at least one of said at least one protrusion is on said base and at least one of said at least one recess is on said at least one mounting portion.

23. A booklet as in claim 21 wherein at least one of said at least one protrusion is on said base and at least one of said at least one recess is on said at least one mounting portion.

* * * * *